US010563828B2

(12) United States Patent
Tsai et al.

(10) Patent No.: US 10,563,828 B2
(45) Date of Patent: Feb. 18, 2020

(54) LAMP

(71) Applicant: PEGATRON CORPORATION, Taipei (TW)

(72) Inventors: Yau-You Tsai, Taipei (TW); Chih-Hsien Tsung, Taipei (TW); Hsin-Tsung Sung, Taipei (TW); Chau-Du Liao, Taipei (TW); Wen-Long Shi, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 0 days.

(21) Appl. No.: 16/191,787

(22) Filed: Nov. 15, 2018

(65) Prior Publication Data

US 2019/0211981 A1 Jul. 11, 2019

(30) Foreign Application Priority Data

Jan. 8, 2018 (TW) ..... 107100700 A

(51) Int. Cl.

| | |
|---|---|
| ***F21S 8/00*** | (2006.01) |
| ***F21V 1/06*** | (2006.01) |
| ***F21V 17/10*** | (2006.01) |
| ***F21V 21/30*** | (2006.01) |
| ***F21V 23/04*** | (2006.01) |
| ***F21W 121/00*** | (2006.01) |
| ***F21Y 115/10*** | (2016.01) |

(52) U.S. Cl.

CPC ..... *F21S 8/033* (2013.01); *F21V 1/06* (2013.01); *F21V 17/10* (2013.01); *F21V 21/30* (2013.01); *F21V 23/04* (2013.01); *F21W 2121/00* (2013.01); *F21Y 2115/10* (2016.08)

(58) Field of Classification Search

None

See application file for complete search history.

(56) References Cited

U.S. PATENT DOCUMENTS

2012/0320606 A1* 12/2012 Vossoughi ..... F21V 1/00 362/351
2016/0298819 A1* 10/2016 Tsung ..... F21V 1/06

FOREIGN PATENT DOCUMENTS

CN 106931370 A 7/2017
CN 203731195 U 7/2017

* cited by examiner

*Primary Examiner* — Britt D Hanley

(74) *Attorney, Agent, or Firm* — Muncy, Geissler, Olds & Lowe, P.C.

(57) ABSTRACT

A lamp includes a casing, an elastic cover and a main body. The casing has an opening. The elastic cover covers the casing. The main body is disposed at the casing, and includes a base plate, a rotating element, a moving element, a linking-up element and a force member. The rotating element is pivoted to the base plate and located at the opening. The moving element is disposed at the base plate. Two ends of the linking-up element are connected to the rotating element and the moving element, respectively. The force member is connected to the moving element. When the force member receives a force, the moving element is moved from a first position to a second position, the linking-up element brings the rotating element to rotate away the base plate, and the rotating element is protruded from the opening, and pushes against the elastic cover.

11 Claims, 7 Drawing Sheets

LAMP

CROSS-REFERENCE TO RELATED APPLICATION

This application is based upon and claims priority of Taiwan Patent Application No. 107100700, filed on Jan. 8, 2018, the contents being incorporated herein by reference.

BACKGROUND

1. Technical Field

The application relates to a lamp.

2. Description of the Related Art

The existing lamp is mainly installed on the ceiling, or standing on the table or the ground, which may occupy a certain space. Currently, the wall lamps or xenon lamps can be installed in the wall to save space.

The wall lamp has a more diversified design. However, people would still notice the existence of lighting on the wall when the lamp is not in use. The xenon lamp can be installed in the wall surface, so it is difficult to notice the xenon lamp when it is not in use. However, the wall must be destroyed before installing the xenon lamp. Moreover, the position of xenon lamp installed must be planned before the interior design and decoration. It is difficult to apply to the general consumers who install themselves after purchasing the xenon lamp. In addition, the appearance of the xenon lamp is monotonous, and either the wall lamp or the xenon lamp has the same configuration in both the use state and non-use state, which lacks the joy of use.

SUMMARY

In view of the above problem, it is an objective of the present application to provide a lamp, which includes a main body and an elastic cover. The main body has a rotating element. When the lamp is turned on, the rotating element rotates and pushes against the elastic cover. This may solve the problem that the conventional lamp lacks the joy of use.

To achieve the above objective, the present application provides a lamp, which includes a casing, an elastic cover and a main body. The casing has an opening and an outer surface. The elastic cover covers the outer surface of the casing. The main body is disposed at the casing, and includes a base plate, a rotating element, a fastening element, a moving element, a linking-up element and a force member. The rotating element is pivoted to the base plate and located at the opening. The fastening element is disposed at the base plate. The moving element has an engaging portion. Also, the moving element is disposed at the base plate and moved between a first position and a second position. The linking-up element has a first end and a second end. The first end is connected to the rotating element, and the second end is connected to the moving element. The force member is connected to the moving element. When the force member receives a force, the moving element is moved from the first position to the second position. The engaging portion is buckled with the fastening element. The second end of the linking-up element is moved to the second position with the moving element, the first end of the linking-up element brings the rotating element to rotate away the base plate, and the rotating element is protruded from the opening and pushes against the elastic cover.

According to an embodiment of the present application, a shortest distance between the first position and the rotating element is less than a shortest distance between the second position and the rotating element.

According to an embodiment of the present application, the main body further includes a lighting assembly disposed at the base plate. The lighting assembly includes a lighting unit and a switch coupled to each other. The switch is adjacent to the fastening element. When the moving element is moved to the second position, a part of the moving element triggers the switch.

According to an embodiment of the present application, moving element further includes a trigger portion. When the moving element is moved to the second position, the trigger portion pushes against the switch.

According to an embodiment of the present application, the engaging portion and the trigger portion are located at opposite sides of the moving element, and the switch is spaced apart from the fastening element. The moving element is moved between the fastening element and the switch.

According to an embodiment of the present application, lighting assembly further includes a light guide plate which is disposed at the base plate corresponding to the opening of the casing.

According to an embodiment of the present application, rotating element further includes two torsion springs respectively sleeved at the opposite ends of the rotating element.

According to an embodiment of the present application, when the force member receives another force, the engaging portion is disengaged from the fastening element, each of the torsion springs provides an elastic force to rotate the rotating element toward the base plate, and the moving element is moved to the first position with the second end of the linking-up element.

According to an embodiment of the present application, the casing further includes a slide rail. The moving element is located within the slide rail.

According to an embodiment of the present application, main body further includes a sub-rotating element and at least a connecting element. The sub-rotating element is pivoted to the base plate and arranged in parallel with the rotating element. The connecting element connects the rotating element and the sub-rotating element.

According to an embodiment of the present application, the linking-up element is a hard rod, the connecting element is a wire material.

As described above, according to a lamp in the present application, to turn on the light, a force is applied to the force member, the moving element can be moved from the first position to the second position, the linking-up element is moved along with the moving element to the second position and bringing the rotating element to rotate away from the base plate. Then, the rotating element is protruded from the opening and pushes against the elastic cover, thereby forming a stereo configuration. Moreover, the engaging portion is fastened to the fastening element to maintain the stereo configuration. Therefore, in the use state (the light is turned on), the surface of the lamp is present as a stereo configuration with the elastic cover being protruded, and in the non-use state (the light is turned off), the surface of the lamp is a flat elastic cover. With this change in shape, the joy of use can be achieved.

DETAILED DESCRIPTION OF THE PREFERRED EMBODIMENT

Hereafter, the technical content of the present application will be better understood with reference to preferred embodiments.

Figure 1:
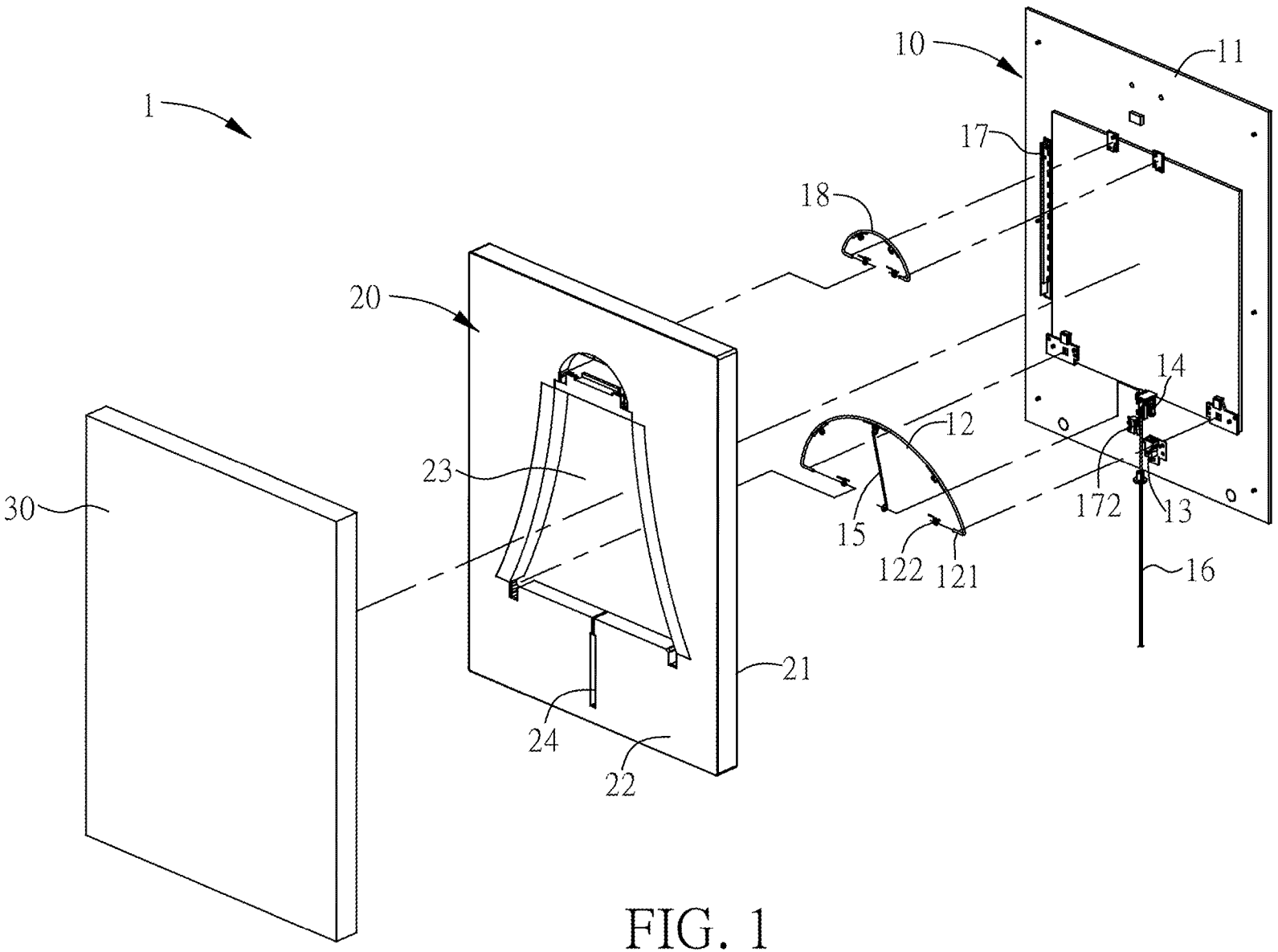
FIG. 1 is an exploded perspective view of a lamp according to an embodiment of the present application.

Please first refer to FIG. 1. FIG. 1 is an exploded perspective view of a lamp according to an embodiment of the present application. In this embodiment, a lamp 1 includes a main body 10, a casing 20 and an elastic cover 30. The main body 10 includes active components. The casing 20 has an inner surface 21 and an outer surface 22 opposite to each other. The casing 20 is disposed at the main body 10, and the inner surface 21 corresponds to the main body 10. That is, the casing 20 is disposed between the elastic cover 30 and the man body 10. The outer surface 22 of the casing 20 may be a smooth surface, and the elastic cover 30 covers the outer surface 22 of casing 20. Preferably, the elastic cover 30 can be a flexible and permeable fabric, such as a Lycra fabric. When the lamp 1 is in use (the light is turned on), the elastic cover 30 can be in a stereo configuration and transparent. The details will be further described later.

Figure 2A:
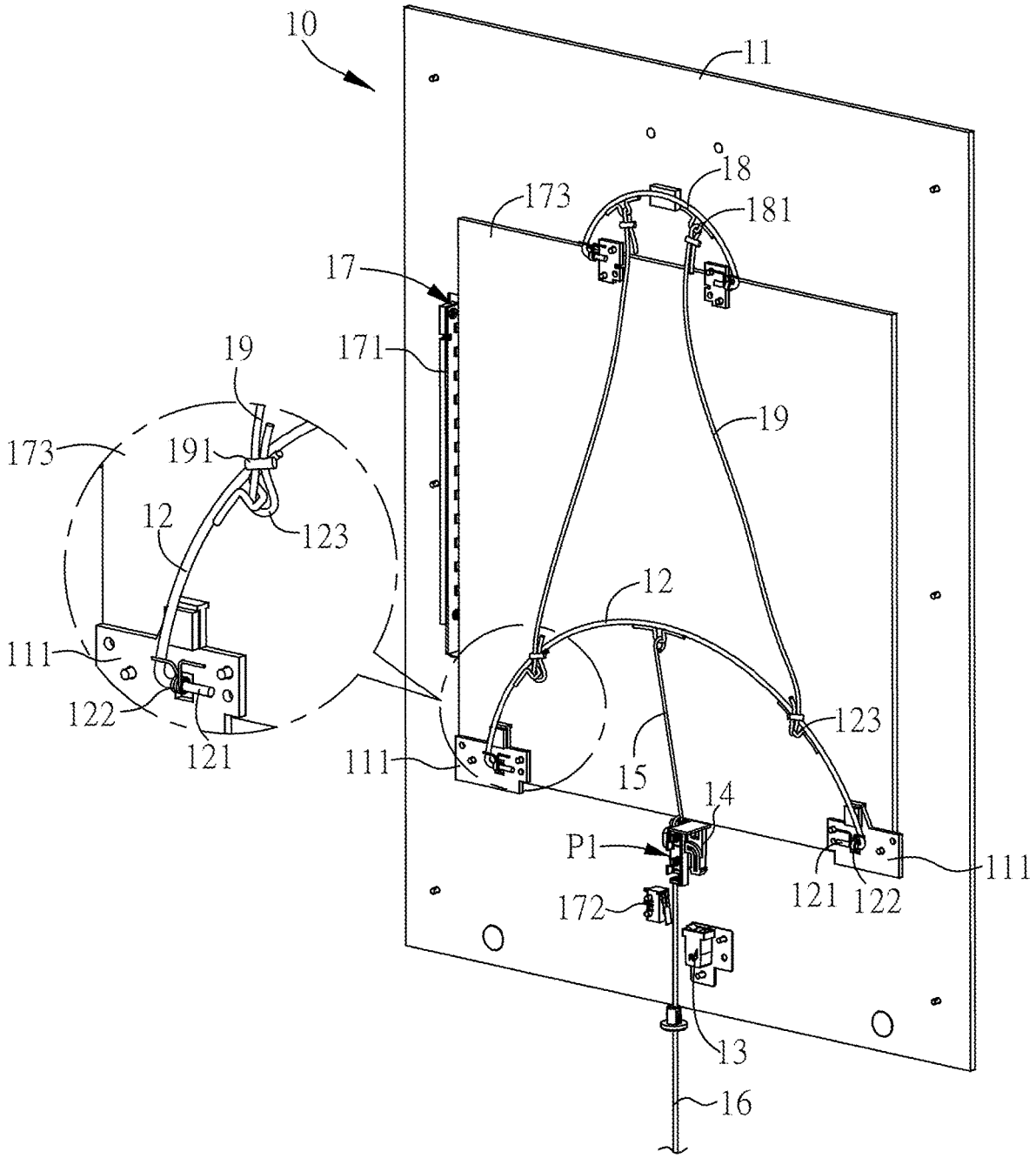
FIG. 2A is a schematic diagram of a main body shown in FIG. 1.
Figure 2B:
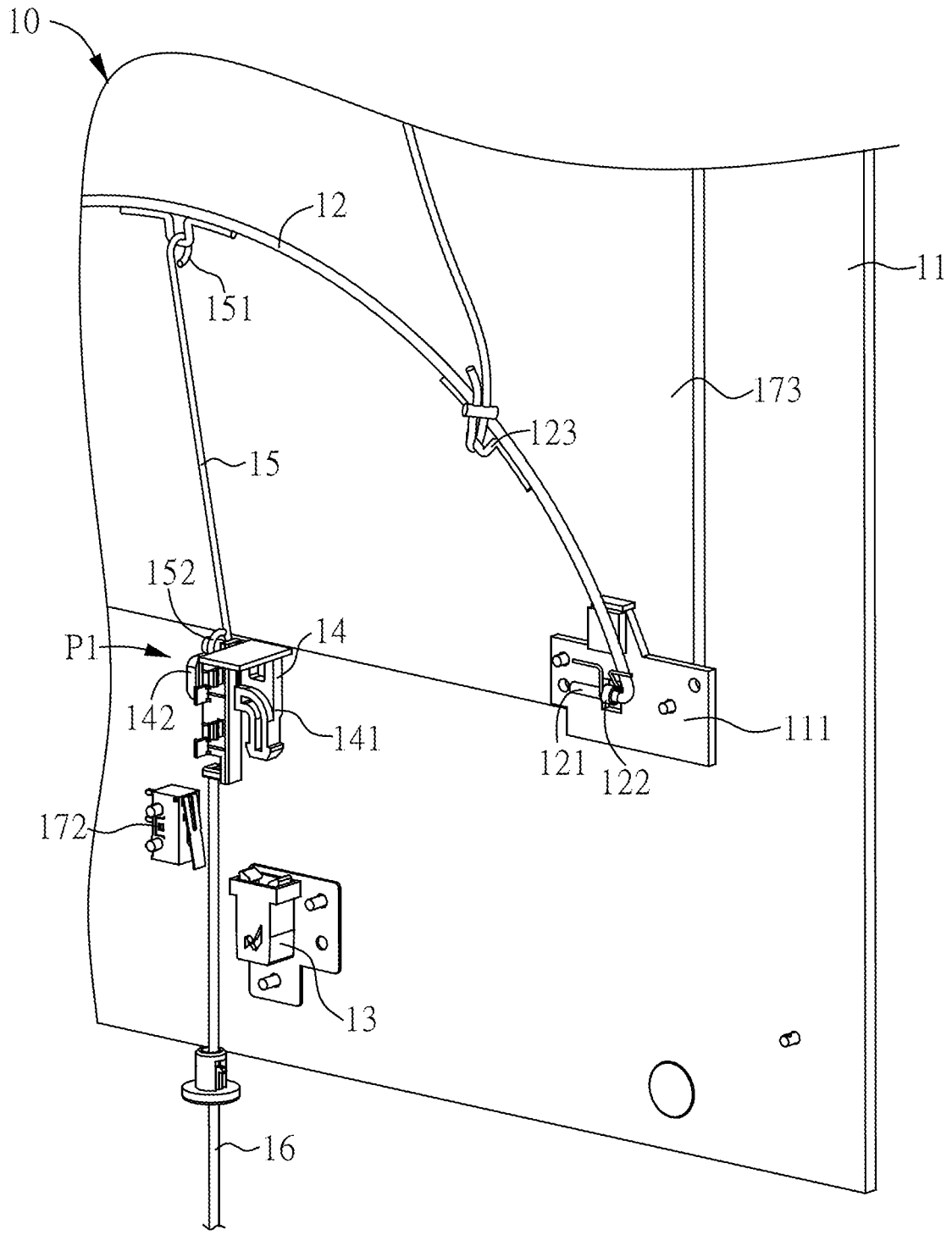
FIG. 2B is a partial enlarged view of the main body shown in FIG. 2A.

FIG. 2A is a schematic diagram of a main body shown in FIG. 1. FIG. 2B is a partial enlarged view of the main body shown in FIG. 2A. Please refer to FIGS. 1, 2A, and 2B. In this embodiment, the main body 10 includes a base plate 11, a rotating element 12, a fastening element 13, a moving element 14, a linking-up element 15, a force member 16 and a lighting assembly 17. The rotating element 12 is pivoted to the base plate 11. The rotating element 12 of this embodiment is a strip-shaped bracket and has an arc or semicircular shape or other configurations, but the present invention is not limited thereto. The opposite ends of the rotating element 12 are bent to form pivoting portions 121. The pivoting portions 121 are connected to the base plate 11, such that the whole of the rotating element 12 can rotate relative to the base plate 11 with the pivoting portion 121 as the axis. Further, the casing 20 includes an opening 23, the main body 10 is disposed behind the casing 20, and the rotating element 12 is located at the opening 23, such that the rotating element 12 is not blocked by the casing 20 during the rotation and can be protruded from the opening 23 (referring to FIG. 5).

Preferably, the rotating element 12 further has two torsion springs 122. Two torsion springs 12 are respectively sleeved at opposite ends of the rotating element 12, i.e. sleeved at the pivoting portion 121. Specifically, the base plate 11 further includes a fixing portion 111. One end of the torsion spring 122 is fixed to the base plate 11. In this embodiment, the torsion spring 122 is fixed to the fixing portion 111 of the base plate 11, and the opposite end of the torsion spring 122 is connected to the rotating element 12, such that the rotating element 12 returns to the original elastic state. The details will be further described later.

In the present embodiment, the movement of the rotating element 12 is achieved by the moving element 14, the linking-up element 15 and the force member 16. First, the moving element 14 is disposed at the base plate 11, and can be moved on the base plate 11. Preferably, the casing 20 further has a slide rail 24 (as shown in FIG. 1). When the casing 20 is placed at the main body 10, the moving element 14 is located in the slide rail 24 and can be moved within the slide rail 24. The slide rail 24 of this embodiment is a through hole penetrating through the casing 20, and in other embodiments, a groove may be formed on the inner surface 21 of the casing 20, but the present application is not limited thereto. Moreover, the linking-up element 15 has a first end 151 and a second end 152 (as shown in FIG. 2B). The first end 151 is connected to the rotating element 12, and the second end 152 is connected to the moving element 14. When the moving element 14 is moving, the linking-up element 15 provides a rotational force to the rotating element 12 relative to the base plate 11. In addition, one end of the moving element 14 is connected to the linking-up element 15, and the opposite end of the moving element 14 is connected to the force member 16, such that the user can apply force to the force member 16. The present application does not limit the configuration and material of the force member 16, preferably a rope that is easy for the user to apply force, such as, but not limited to, cotton thread, nylon rope, leather cord, iron chain, or a combination thereof.

Figure 3:
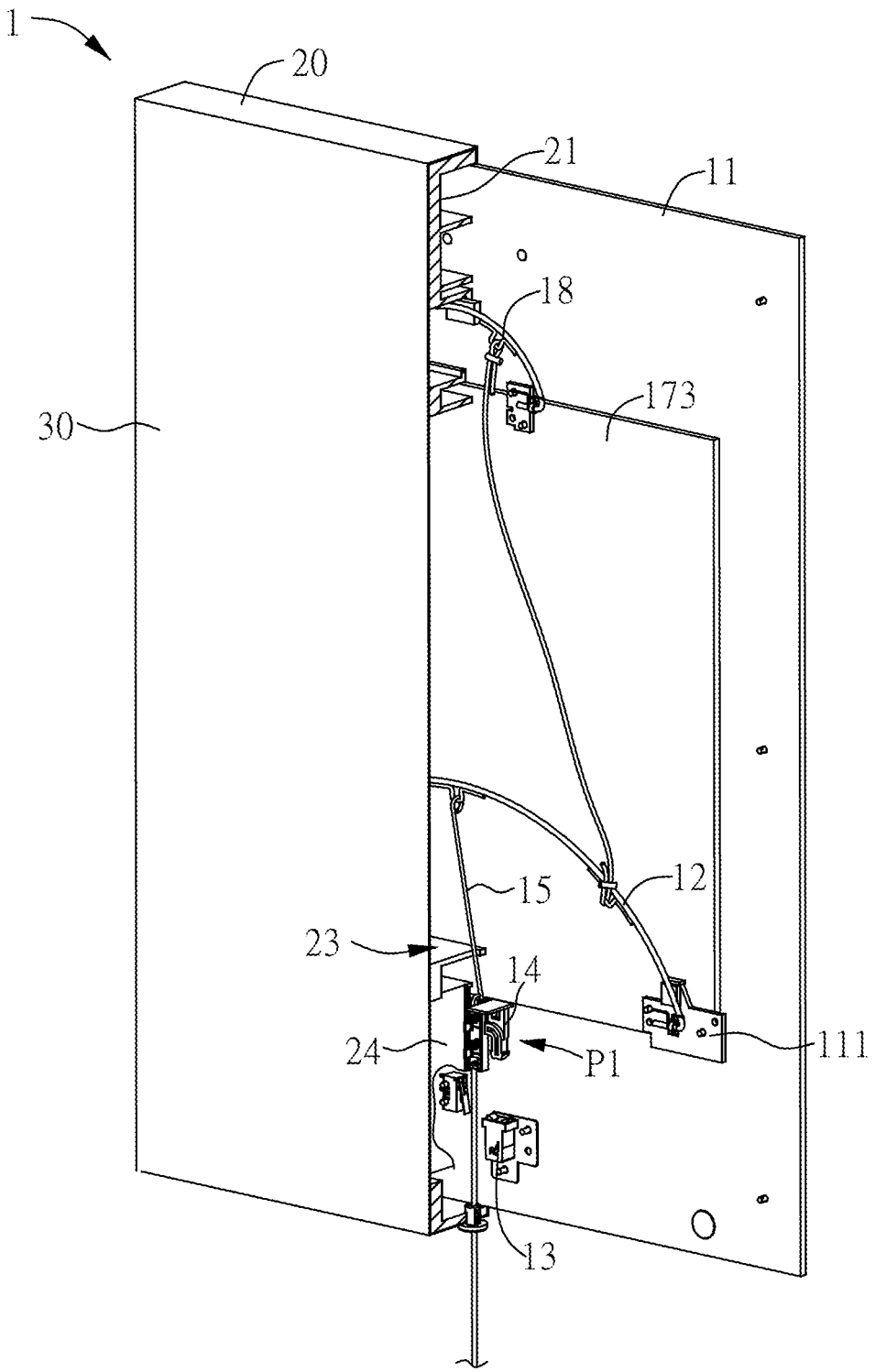
FIG. 3 is a partial cross-sectional view showing the combination of the lamp shown in FIG. 1.

When a user applies a force to the force member 16, the moving element 14 can be moved on the base plate 11 (within the slide rail 24). The present embodiment uses the movement of the moving element 14 between a first position P1 and a second position P2 as an example for illustration, and both of FIGS. 2A and 2B are schematic diagrams showing the moving element 14 at the first position P1. When the lamp 1 is in the non-use state (i.e. the light is turned off), the moving element 14 is located at the first position P1. At this time, the rotating element 12 is substantially parallel to the base plate 11 and is accommodated in the opening 23 of the casing 20, so the surface of lamp 1 is a flat elastic cover 30, as shown in FIG. 3 which is a partial cross-sectional view of the lamp shown in FIG. 1 being assembled and in the non-use state.

Figure 4A:
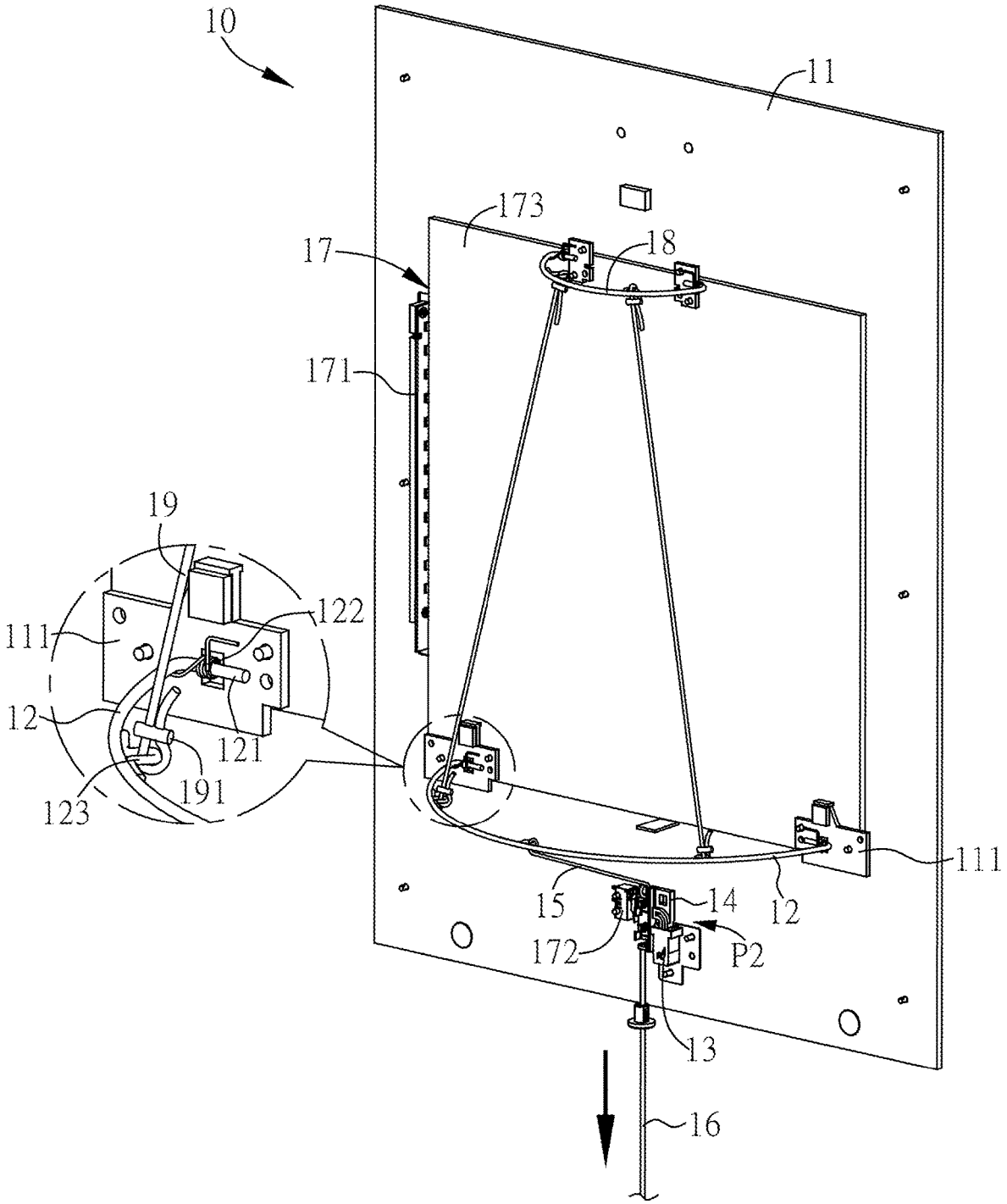
FIG. 4A is a schematic diagram showing the moving element in FIG. 2A moving to the second position.
Figure 4B:
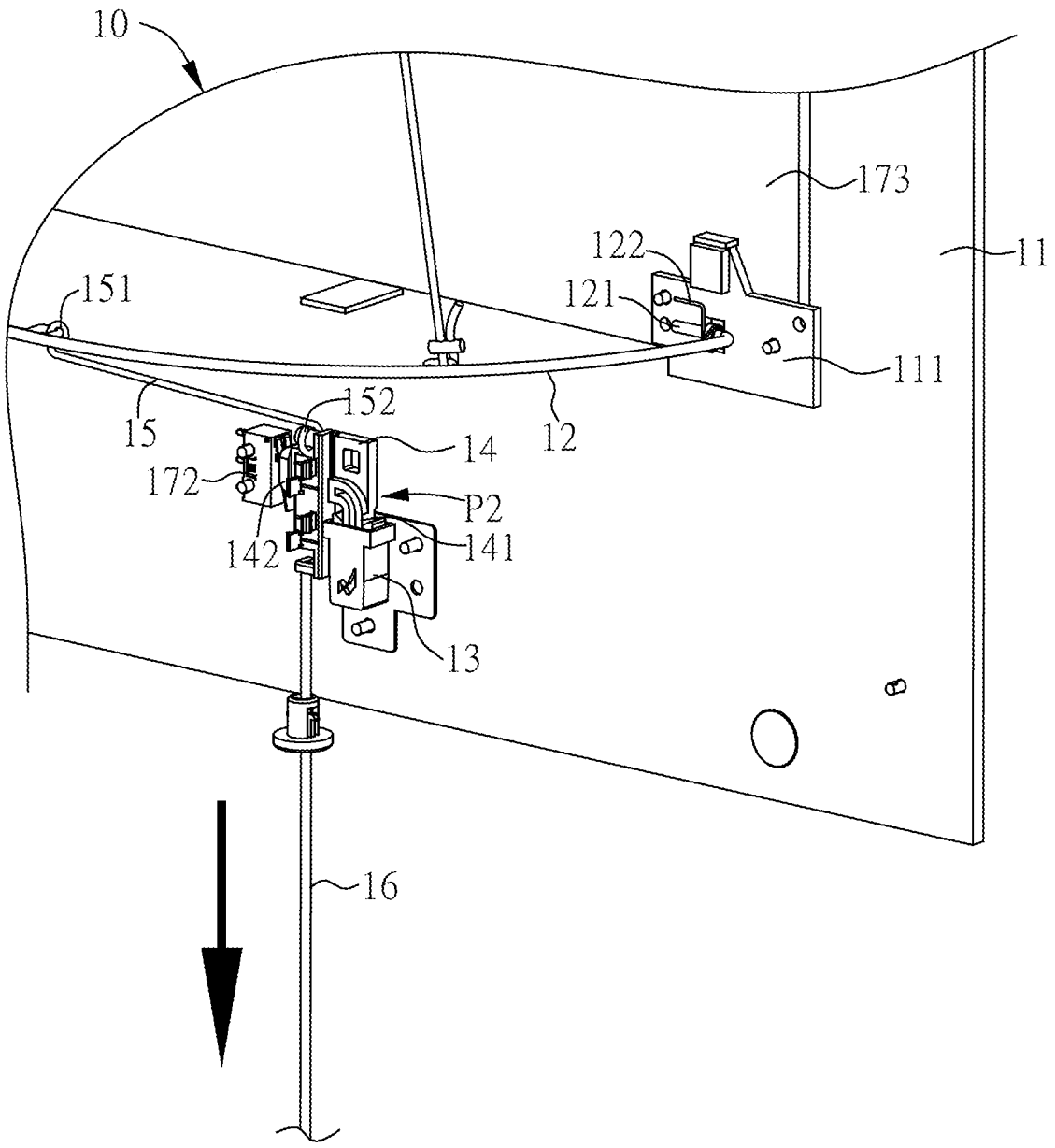
FIG. 4B is a partial enlarged view of the main body shown in FIG. 4A.
Figure 5:
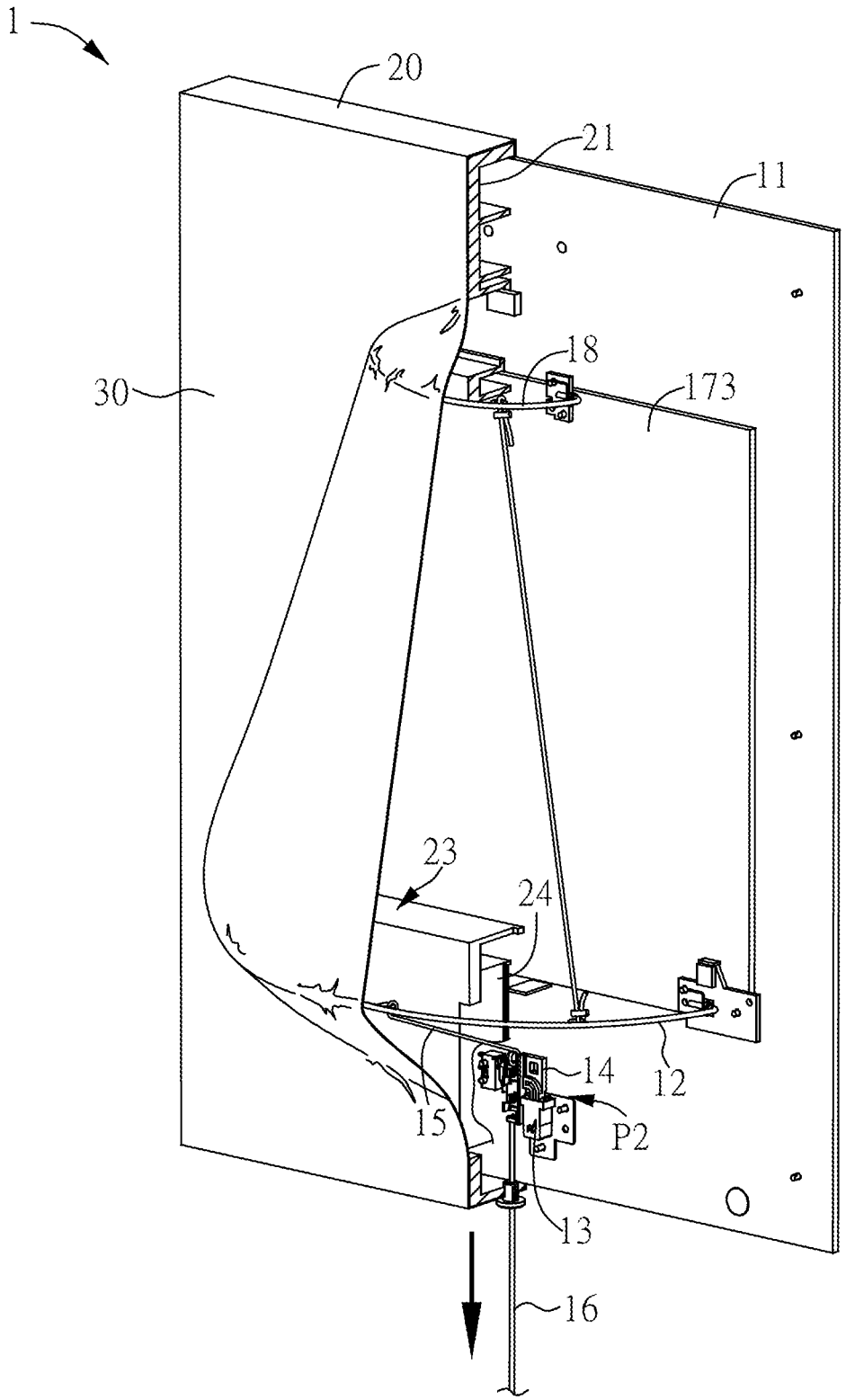
FIG. 5 is a partial cross-sectional view showing the lamp in FIG. 1 being assembled and in use.

To turn on the light, the user may pull the force member 16. When the force member 16 receives the downward pulling force, the moving element 14 is moved from the first position P1 to the second position P2. As shown in FIGS. 4A, 4B, and 5, where FIG. 4A is a schematic diagram showing the moving element in FIG. 2A moving to the second position; FIG. 4B is a partial enlarged view of the main body shown in FIG. 4A; and FIG. 5 is a partial cross-sectional view showing the lamp in FIG. 1 being assembled and in use. Please refer to FIGS. 2A, 2B and 3 for the illustration of the first position P1. Please refer to FIGS. 4A, 4B, and 5 for the illustration of the second position P2. When the moving element 14 is moved, the second end 152 of the linking-up element 15 is moved together with the moving element 14, and then moved to the second position P2 (as shown in FIG. 4B). At the same time, the first end 151 of the linking-up element 15 can provide a rotating force of the rotating element 12 relative to the base plate 11. That is, the linking-up element 15 brings the rotating element 12 to rotate away from the base plate 11. Also, the rotating element 12 can be protruded from the opening 23 of the casing 20 and push against the elastic cover 30 around the outside of the casing 20 (as shown in FIG. 5). In other words, after the rotating element 12 is rotated in a direction perpendicular to the base plate 11, the rotating element 12 passes through the opening 23 and directly pushes against the elastic cover 30, such that the elastic cover 30 is formed into an outwardly protruding stereo configuration.

In the present embodiment, the shortest distance between the first position P1 and the rotating element 12 is smaller than the shortest distance between the second position P2 and the rotating element 12. That is, the first position P1 is closer to the rotating element 12 than the second position P2. Taking the direction in the figure as example, if the first position P1 and the second position P2 are both below the rotating element 12, and the second position P2 is located below the first position P1. Therefore, the moving element 14 can be moved from the first position P1 to the second position P2 through pulling down the force member 16 by a user. Then, the linking-up element 15 is moved downward, and the rotating element 12 is pulled down simultaneously. Thus, the rotating element 12 to be rotated into a state perpendicular to the base plate 11.

To maintain the moving element 14 in the second position P2 and maintain the elastic cover 30 in the outwardly protruding stereo configuration, the moving element 14 has an engaging portion 141 (as shown in FIG. 2B), and the fastening element 13 is disposed at base plate 11 near the second position P2. Therefore, when the moving element 14 is moved to the second position P2, the engaging portion 141 can be engaged with the fastening element 13, and the moving element 14 is maintained at the second position P2, while the elastic cover 30 is maintained in the outwardly protruding stereo configuration.

In addition, the lighting assembly 17 is also disposed at the base plate 11. Specifically, the lighting assembly 17 of the embodiment includes a lighting unit 171 and a switch 172 coupled to each other. The switch 172 is adjacent to the fastening element 13. Accordingly, when the moving element 14 is moved to the second position P2, the elastic cover 30 is in the outwardly protruding stereo configuration, and a portion of the moving element 14 can trigger the switch 172 to activate the lighting unit 171 for achieving turning on the light. In this embodiment, the moving element 14 further includes a trigger portion 142. Preferably, the engaging portion 141 and the trigger portion 142 are located at opposite sides of the moving element 14. Moreover, the switch 172 is spaced apart from the fastening element 13, which means apart from the moving path of the moving element 14. That is, the switch 172 and the fastening element 13 are located at opposite sides of the slide rail 24, and the moving element 14 is moved between the fastening element 13 and the switch 172. When the moving element 14 is moved to the second position P2, the trigger unit 142 is pressed against the switch 172 such that the lighting unit 171 is turned on. The engaging portion 141 is fixed to the fastening element 13, such that the lamp 1 can be maintained in the light and on the stereo configuration state (the elastic cover 30 is outwardly protruding).

Moreover, the present application does not limit the type of lighting unit 171, such as, but not limited to, a white light, a fluorescent light, or a Light-Emitting Diode (LED). The LED can be preferably used as the lighting unit 171 in the present embodiment. Preferably, the lighting assembly 17 further includes a light guide plate 173 which is disposed at the base plate 11. In this embodiment, the light guide plate 173 is fixed to the base plate 11 by the fixing portion 111. One side of the light guide plate 173 is connected to the lighting unit 171, and disposed at the position corresponding to the opening 23, so that the light emitted by the lighting unit 171 can be emitted through the light guide plate 173, and sequentially passes through the opening 23 and the elastic cover 30 with the transparent material. Preferably, the elastic cover 30 can have a variety of patterns. When the light of the lighting unit 171 penetrates the elastic cover 30, a variety of different variations can be presented.

Preferably, the fastening element 13 in the embodiment may be a push-push fastening element. After the engaging portion 141 is engaged with the fastening element 13, when the force member 16 receives another force (i.e., the user applies a force to the force member 16 once again), the engaging portion 141 can be disengaged from the fastening element 13. At this time, the torsion spring 122 can provide an elastic force to rotate the rotating element 12 in the direction toward the base plate 11, and the moving element 14 is moved along with the second end 152 of the linking-up element 15 to the first position P1, to return to the light-off state. In detail, when the moving element 14 is at the first position P1, the rotating element 12 is parallel to the base plate 11, and the torsion spring 122 is in an uncompressed state. When the linking-up element 15 is moved along with the moving element 14 to the second position P2, the rotating element 12 is perpendicular to the base plate 11, and the torsion spring 122 is in a compressed state. In this embodiment, the engaging portion 141 and the fastening element 13 are engaged with each other to maintain the moving element 14 in the second position P2, and maintain the torsion spring 122 in a compressed state. Accordingly, when the engaging portion 141 is disengaged from the fastening element 13, the torsion spring 122 returns to the uncompressed state and provides an elastic power enabling the rotating element 12 to return to be parallel to the base plate 11. At the same time, the linking-up element 15 further pulls the moving element 14 back to the first position P1.

It should be noted that the present application does not limit the configuration and material of the linking-up element 15. Specifically, the rotating element 12 applies a force to the torsion spring 122 when moving away from the base plate 11, so the linking-up element 15 may preferably be a hard rod, such as a metal rod. Moreover, the first end 151 and the second end 152 of the linking-up element 15 are pivotally connected to the rotating element 12 and the moving element 14, respectively, to cooperate with the rotation of the rotating element 12.

Further, the lamp 1 of this embodiment can be directly mounted on a wall surface or other plane, such as a surface of a furniture. Preferably, the force member 16 is located below for hanging naturally. In the non-use state (the light is turned off), the surface of the lamp 1 is a flat elastic cover 30. When the force member 16 is pulled down, the elastic cover 30 is protruded to form a stereo configuration. With this change in shape, the joy of use can be achieved.

Preferably, the main body 10 in the present embodiment further includes a sub-rotating element 18 and at least a connecting element 19. The sub-rotating element 18 is pivoted to the base plate 11, and the rotating element 12 and the sub-rotating element 18 are connected by the connecting element 19, such that the sub-rotating element 18 can be moved with the rotating element 12. In this embodiment, the sub-rotating element 18 and the rotating element 12 are both arc shaped, the sub-rotating element 18 is smaller in size than the rotating element 12, and the sub-rotating element 18 is arranged in parallel with the rotating element 12. Moreover, the connecting element 19 of this embodiment is illustrated by a wire material, and the connecting element 19 may be a cotton, nylon, or leather rope. As shown in FIGS. 2A and 4A, the wire material (the connecting element 19) may be wound around the rotating element 12 and the sub-rotating element 18 to be coupled to the rotating element 12 and the sub-rotating element 18. Preferably, the rotating element 12 and the sub-rotating element 18 respectively have a fixing ring 123 and a fixing ring 181 for providing the connecting element 19 winding. The connecting element 19 further has a pressing buckle 191. In this embodiment, the connecting element 19 is wound around the fixing ring 123, the fixing ring 181 a circle, and then fixed by the pressing buckle 191.

When the moving element 14 is moved to the second position P2, the linking-up element 15 brings the rotating element 12 to rotate away from the base plate 11, and applies a force to the sub-rotating element 18 through the connecting element 19, such that the sub-rotating element 18 also rotates away from the base plate 11 at the same time. The rotating element 12 and the sub-rotating element 18 both pass through from the opening 23 and push against the elastic cover 30, such that the elastic cover 30 is formed into a half flat-topped conical stereo configuration (as shown in FIG. 5).

Preferably, the pivot of the sub-rotating element 18 and the base plate 11 are also provided with a torsion spring with the configuration and force the same as the torsion spring 122 of the rotating element 12. Therefore, when the engaging portion 141 is disengaged from the fastening element 13, the torsion spring sleeved at the sub-rotating element 18 can also provide an elastic force to the sub-rotating element 18, such that the sub-rotating element 18 returns to the state parallel to the base plate 11.

It should be noted that the present application does not limit the configuration of the sub-rotating element 18, the sub-rotating element 18 may be the same as or different from the rotating element 12, and does not limit the number and arrangement positions of the sub-rotating elements 18. It can be adjusted according to the stereo configuration that is formed after the elastic cover 30 is applied. The present application also does not limit the configuration and material of the connecting element 19, and can also be adjusted according to the stereo configuration to be formed. For example, the connecting element 19 in the present embodiment is a less noticeable wire material. That is, since the texture of the wire material is soft, when the rotating element 12 and the sub-rotating element 18 push against the elastic cover 30, on the surface of elastic cover 30, the presence of connecting element 19 is less noticeable. In other embodiments, a receiving groove (not shown) may also be formed in the casing 20, and the connecting element 19 is movably disposed in the receiving groove to prevent the configuration of the connecting element 19 from appearing on the surface of the elastic cover 30.

As above, according to a lamp of the present application, to turn on the light, a force is applied to the force member, and the moving element can be moved from the first position to the second position, and then the linking-up element is moved with the moving element to the second position and bringing the rotating element to rotate away from the base plate. The rotating element is protruded from the opening to push against the elastic cover, thereby forming a stereo configuration. Moreover, the engaging portion is fastened to the fastening element to maintain the stereo configuration. Therefore, in the use state (the light is turned on), the surface of the lamp is present as a stereo configuration with the elastic cover being protruded, and in the non-use state (the light is turned off), the surface of the lamp is a flat elastic cover. With this change in shape, the joy of use can be achieved.

Moreover, the lamp of the present application is mainly composed of a main body, a casing and an elastic cover, and can be directly disposed on the wall surface. In the non-use state (the light is turned off), the surface of the lamp is a flat elastic cover, which further achieves the effect of space saving.

It should be noted that the above-mentioned embodiments are only for illustration. It is intended that the present application cover modifications and variations of this application provided they fall within the scope of the following claims and their equivalents. Therefore, it will be apparent to those skilled in the art that various modifications and variations can be made to the structure of the present application without departing from the scope or spirit of the application.

What is claimed is:

1. A lamp, comprising:
- a casing, having an opening and an outer surface;
- an elastic cover, covering the outer surface of the casing; and
- a main body, disposed at the casing, the main body comprising:
  - a base plate;
  - a rotating element, pivoted to the base plate and located at the opening;
  - a fastening element, disposed at the base plate;
  - a moving element, having an engaging portion, the moving element being disposed at the base plate and moved between a first position and a second position;
  - a linking-up element, having a first end and a second end, the first end being connected to the rotating element, and the second end being connected to the moving element; and
  - a force member, connected to the moving element, wherein when the force member receives a force, the moving element is moved from the first position to the second position, the engaging portion is engaged with the fastening element, the second end of the linking-up element is moved to the second position with the moving element, the first end of the linking-up element brings the rotating element to rotate away from the base plate, and the rotating element is protruded from the opening and pushes against the elastic cover.

2. The lamp as claimed in claim 1, wherein the first position is closer to the rotating element than the second position.

3. The lamp as claimed in claim 1, wherein the main body further comprises a lighting assembly disposed at the base plate, the lighting assembly comprising a lighting unit and a switch coupled to each other, and the switch being adjacent to the fastening element; when the moving element being moved to the second position, a part of the moving element triggering the switch.

4. The lamp as claimed in claim 3, wherein the moving element further comprises a trigger portion, the trigger portion pushing against the switch when the moving element is moved to the second position.

5. The lamp as claimed in claim 4, wherein the engaging portion and the trigger portion are located at opposite sides of the moving element, the switch is spaced apart from the fastening element, and the moving element is moved between the fastening element and the switch.

6. The lamp as claimed in claim 3, wherein the lighting assembly further comprising a light guide plate disposed at the base plate corresponding to the opening of the casing.

7. The lamp as claimed in claim 1, wherein the rotating element further includes two torsion springs respectively sleeved at the opposite ends of the rotating element.

8. The lamp as claimed in claim 7, wherein when the force member receives another force, the engaging portion is disengaged from the fastening element, each of the torsion springs provides an elastic force to rotate the rotating element toward the base plate, and the moving element is moved to the first position with the second end of the linking-up element.

9. The lamp as claimed in claim 1, wherein the casing further comprises a slide rail, and the moving element is located within the slide rail.

10. The lamp as claimed in claim 1, wherein the main body further comprises a sub-rotating element and at least a connecting element, the sub-rotating element is pivoted to the base plate, and the connecting element connects the rotating element and the sub-rotating element.

11. The lamp as claimed in claim 10, wherein the linking-up element is a hard rod, and the connecting element is a wire material.

* * * * *